US009796198B2

(12) United States Patent
Kurita et al.

(10) Patent No.: US 9,796,198 B2
(45) Date of Patent: Oct. 24, 2017

(54) PRINTING EQUIPMENT HOUSING BOX

(71) Applicant: Brother Kogyo Kabushiki Kaisha, Nagoya-shi, Aichi-ken (JP)

(72) Inventors: Kenji Kurita, Kariya (JP); Takamine Hokazono, Kasugai (JP); Hidenori Jo, Nagoya (JP); Hitoshi Sanada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/360,606

(22) Filed: Nov. 23, 2016

(65) Prior Publication Data

US 2017/0072724 A1 Mar. 16, 2017

Related U.S. Application Data

(63) Continuation of application No. 15/050,512, filed on Feb. 23, 2016, now Pat. No. 9,505,248.

(30) Foreign Application Priority Data

Feb. 23, 2015 (JP) ..... 2015-033142

(51) Int. Cl.
*B41J 29/13* (2006.01)
*B41J 29/02* (2006.01)

(52) U.S. Cl.
CPC ..... *B41J 29/13* (2013.01); *B41J 29/02* (2013.01)

(58) Field of Classification Search
CPC ... B41J 29/02; B41J 29/12; B41J 29/13; B41J 29/38
See application file for complete search history.

(56) References Cited

U.S. PATENT DOCUMENTS 4,645,275 A * 2/1987 Pucci ..... B41J 29/13 312/223.2
5,732,321 A 3/1998 Ishizuka et al.
2004/0067089 A1* 4/2004 Tanaami ..... B41J 29/02 400/693
2012/0050448 A1 3/2012 Sakaino
(Continued)

FOREIGN PATENT DOCUMENTS

JP 2013-230572 A 11/2013

*Primary Examiner* — Geoffrey Mruk
*Assistant Examiner* — Scott A Richmond
(74) *Attorney, Agent, or Firm* — Banner & Witcoff, Ltd.

(57) ABSTRACT

A printing equipment housing box includes an equipment housing portion, an outer wall, and a cover. The equipment housing portion houses printing equipment. The outer wall includes a paper discharge port penetrating through the outer wall. The paper discharge port discharges, to the outside of the printing equipment housing box, a medium printed by the printing equipment in the equipment housing portion, The through hole extends in a first direction. The cover is provided between the outer wall and the equipment housing portion. The cover moves in a gap between the outer wall and the equipment housing portion in a second direction orthogonal to the first direction. The cover moves between a closed position and an open position along the inner side of the outer wall. The cover closes the paper discharge port in the closed position and the cover opens the paper discharge port in the open position.

9 Claims, 13 Drawing Sheets

(56) References Cited

U.S. PATENT DOCUMENTS

| | | | | |
|---|---|---|---|---|
| 2013/0292955 | A1* | 11/2013 | Higgins | B60Q 9/00 292/195 |
| 2014/0022324 | A1* | 1/2014 | Huang | B41J 29/13 347/108 |

* cited by examiner

PRINTING EQUIPMENT HOUSING BOX

CROSS-REFERENCE TO RELATED APPLICATION

This application is a Continuing application of U.S. Ser. No. 15/050,512 filed on Feb. 23, 2016, which claims priority to Japanese Patent Application No. 2015-033142 filed on Feb. 23, 2015, the disclosure of which is herein incorporated by reference in its entirety.

BACKGROUND

The present disclosure relates to a printing equipment housing box capable of housing printing equipment.

In a printer, there is a requirement to inhibit water, dirt, dust or the like from entering inside a housing. In the case of the printer, in particular, it is easy for water, dirt, dust or the like to enter inside the housing from a paper discharge port that discharges paper that has been printed. In known art, a recording device that is provided with a paper discharge tray is known. The paper discharge tray is provided such that it can rotate with respect to a housing. The paper discharge tray can be switched between a state of being extended vertically along a front wall portion of the housing and a state of being extended substantially horizontally after being tilted toward the front. A paper discharge port is formed in a lower side of the front wall portion. The paper discharge port is opened and closed by rotating the paper discharge tray.

SUMMARY

In order to inhibit water, dirt, dust or the like from entering inside through the paper discharge port, it is conceivable that the above-described paper discharge tray may be used as a cover. However, when the paper discharge tray is used as the cover, printing is performed when the paper discharge tray is in the horizontally extended state. Thus, it is necessary to sufficiently secure an installation space for the printer to allow space for the paper discharge tray in the horizontally extended state. Further, if the paper discharge tray is not fixed to the housing when in the horizontally extended state, the paper discharge tray may move during the printing, and it is therefore possible that the printing cannot be stably performed.

Various embodiments of the general principles described herein provide a printing equipment housing box capable of housing printing equipment and provided with a cover in order to inhibit water, dust, dirt or the like from entering inside via a paper discharge port, the printing equipment housing box allowing a reduction in installation space and allowing a printing operation to be stably executed.

Embodiments herein provide a printing equipment housing box including an equipment housing portion, an outer wall, and a cover. The equipment housing portion is provided to house printing equipment. The outer wall includes a paper discharge port. The paper discharge port is a through hole and is provided to discharge, to the outside of the printing equipment housing box, a medium printed by the printing equipment housed in the equipment housing portion. The through hole extends in a first direction. The cover is provided between the outer wall and the equipment housing portion. The cover is capable of moving in a gap between the outer wall and the equipment housing portion in a second direction orthogonal to the first direction. The cover is capable of moving between a closed position and an open position along the inner side of the outer wall. The cover closes the paper discharge port in the closed position and the cover opens the paper discharge port in the open position.

Embodiments herein also provide a printing equipment housing box including an equipment housing portion, an outer wall, a cover, a button, and a holding member. The equipment housing portion is provided to house printing equipment. The outer wall includes a paper discharge port. The paper discharge port is a through hole and is provided to discharge, to the outside of the printing equipment housing box, a medium printed by the printing equipment housed in the equipment housing portion. The through hole extends in a first direction. The cover is capable of moving, in a second direction orthogonal to the first direction, between a closed position and an open position along the outer wall. The cover closes the paper discharge port in the closed position and the cover opens the paper discharge port in the open position. The button is capable of moving between a first position and a second position in a direction orthogonal to the outer wall. The holding member is connected to the button. The holding member is capable of holding the cover in the open position. The holding member is capable of releasing the holding the cover held in the open position when disposing the button in the second position.

Embodiments herein also provide a printing equipment housing box including an equipment housing portion, an outer wall, a cover, and a first urging member. The equipment housing portion is provided to house printing equipment. The outer wall includes a paper discharge port. The paper discharge port is a through hole and is provided to discharge, to the outside of the printing equipment housing box, a medium printed by the printing equipment housed in the equipment housing portion. The through hole extends in a first direction. The cover is capable of moving, in a second direction orthogonal to the first direction, between a closed position and an open position along the outer wall. The cover closes the paper discharge port in the closed position and the cover opens the paper discharge port in the open position. The first urging member urges the cover from the open position toward the closed position.

BRIEF DESCRIPTION OF THE DRAWINGS

Embodiments will be described below in detail with reference to the accompanying drawings in which.

DETAILED DESCRIPTION

Hereinafter, a printing equipment housing box 10, which is an embodiment of the present disclosure, will be described with reference to the drawings. A lower left side, an upper right side, an upper left side, a lower right side, an upper side, and a lower side in FIG. 1 respectively correspond to a front side, a rear side, a left side, a right side, an upper side and a lower side of the printing equipment housing box 10.

<Box 11>

Figure 1:
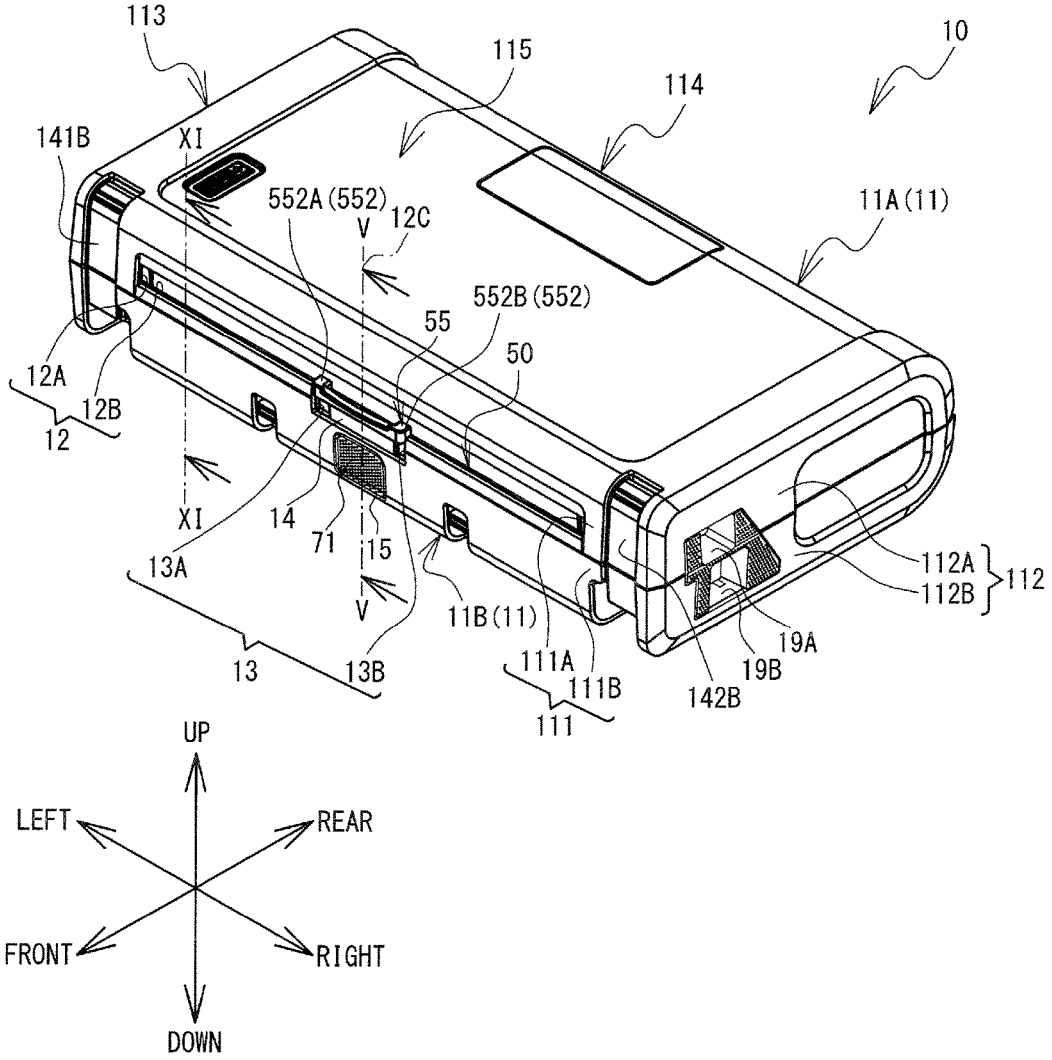
FIG. 1 is a perspective view of a printing equipment housing box 10 when a box 11 is in a closed state.

As shown in FIG. 1, the printing equipment housing box 10 has a box 11. The box 11 is substantially box-shaped and is long in the left-right direction. The box 11 has an upper box 11A and a lower box 11B. The upper box 11A and the lower box 11B respectively correspond to an upper side half of the box 11 and a lower side half of the box 11. The box 11 has a front outer wall 111, a right outer wall 112, a left outer wall 113, a rear outer wall 114, an upper outer wall 115, and a lower outer wall 116 (refer to FIG. 5). A front outer wall 111A, a right outer wall 112A, and a left outer wall 113A of the upper box 11A (refer to FIG. 2), and a rear outer wall 114A (refer to FIG. 2) respectively correspond to the upper side half of the front outer wall 111, the right outer wall 112, the left outer wall 113, and the rear outer wall 114 of the box 11. A front outer wall 111B, a right outer wall 112B, and a left outer wall 113B of the lower box 11B (refer to FIG. 2), and a rear outer wall 114B (refer to FIG. 2) respectively correspond to the lower side half of the front outer wall 111, the right outer wall 112, the left outer wall 113, and the rear outer wall 114 of the box 11.

Figure 2:
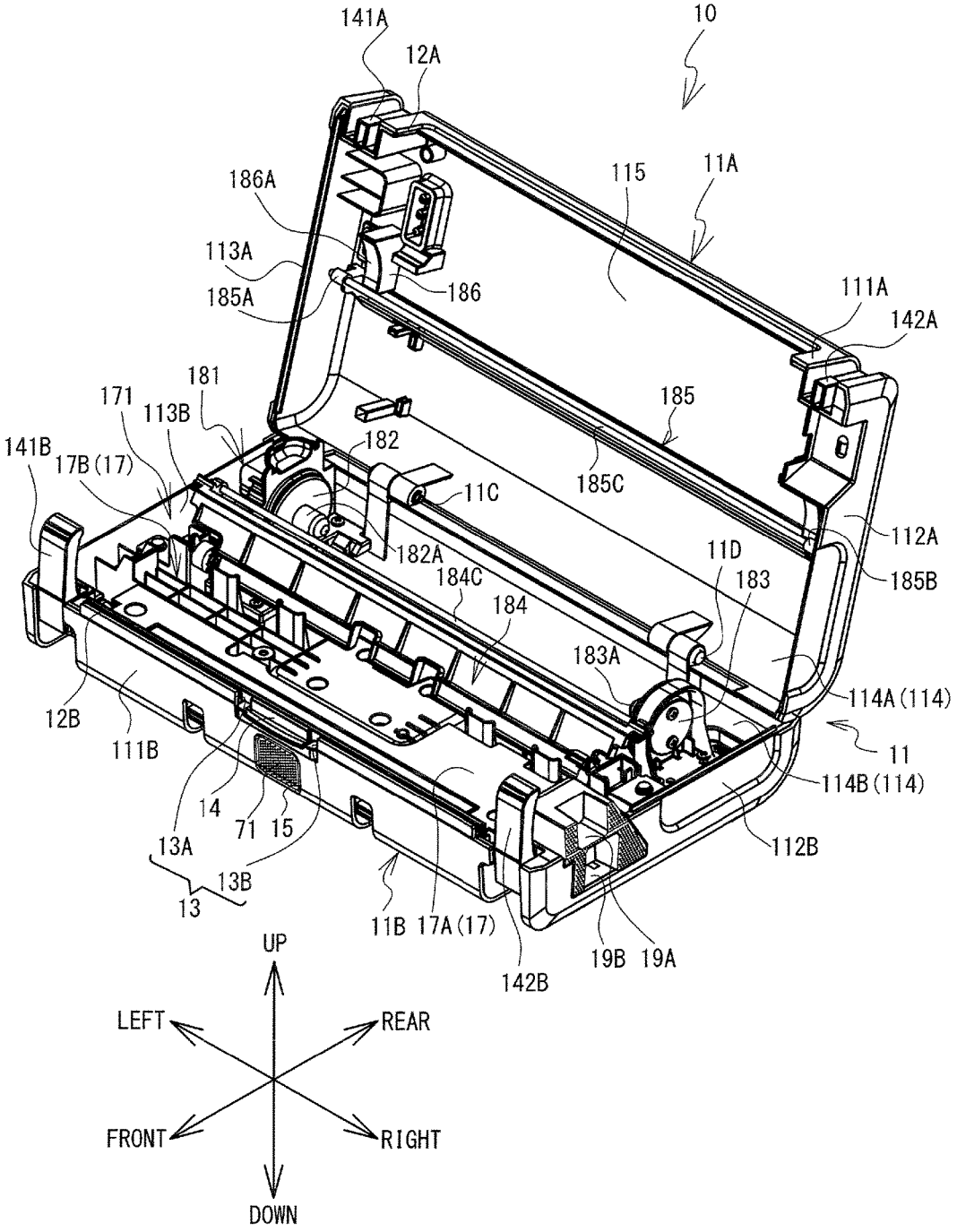
FIG. 2 is a perspective view showing an interior of the printing equipment housing box 10 when the box 11 is in an open state.
Figure 3:
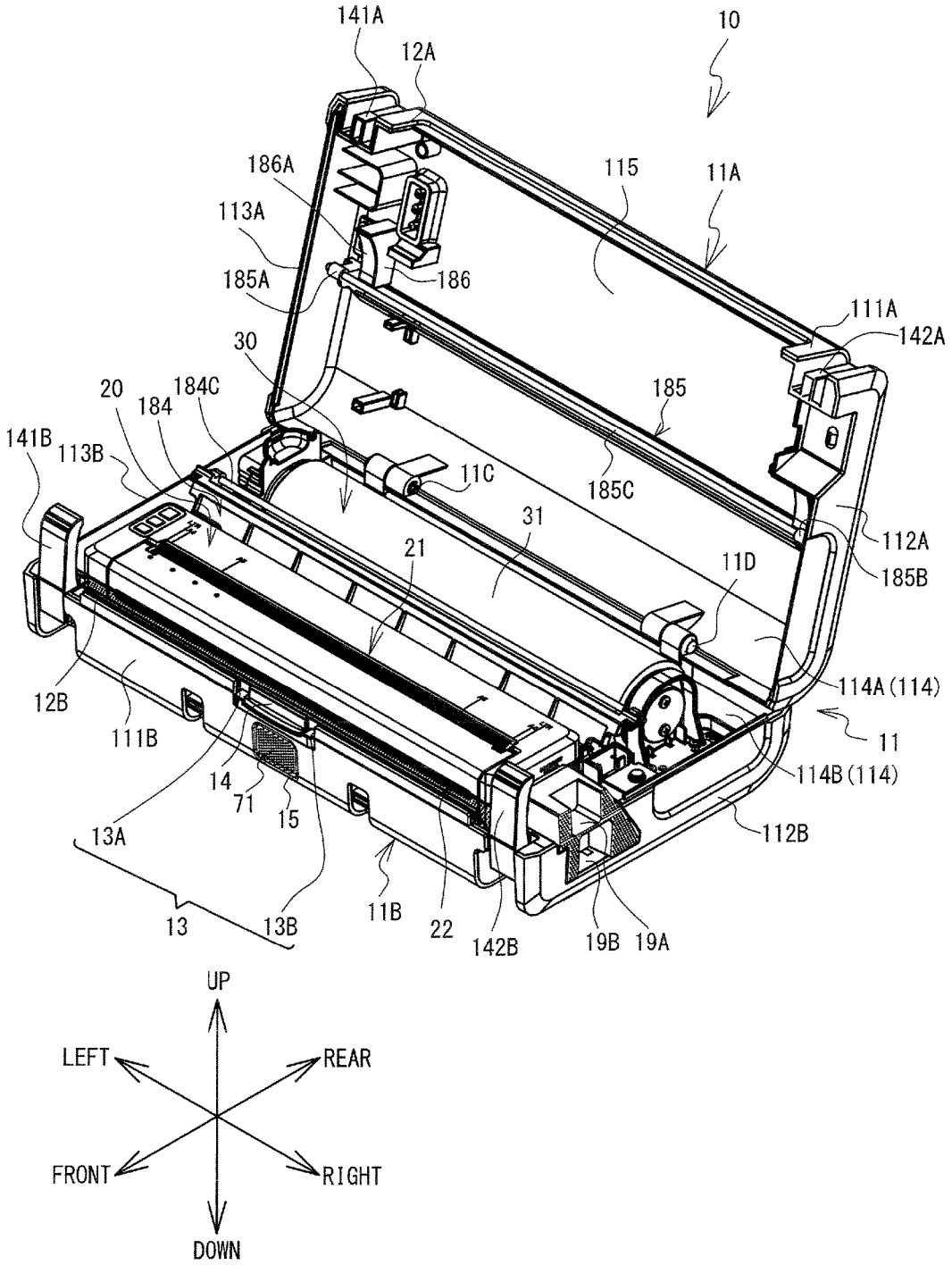
FIG. 3 is a perspective view of the printing equipment housing box 10, printing equipment 20, and a roll 30, when the box 11 is in the open state.

As shown in FIG. 2 and FIG. 3, the upper box 11A and the lower box 11B are connected, at the rear outer wall 114A and the rear outer wall 114B, such that the upper box 11A and the lower box 11B can rotate via shafts 11C and 11D. As a result of the upper box 11A rotating with respect to the lower box 11B, the box 11 changes to a state in which the front outer walls 111A and 111B come into contact with each other (refer to FIG. 1) and to a state in which the front outer walls 111A and 111B are separated (refer to FIG. 2 and FIG. 3). Hereinafter, the state shown in FIG. 1 in which the front outer walls 111A and 111B come into contact with each other is referred to as a "closed state of the box 11" or "when the box 11 is in a closed state." The state shown in FIG. 2 and FIG. 3 in which the front outer walls 111A and 111B are separated from each other is referred to as an "open state of the box 11" or "when the box 11 is in an open state." Hereinafter, where there is no particular limitation, the explanation will be made for the closed state of the box 11.

An extension portion 141B is provided on an end portion on the left side of the front outer wall 111B of the lower box 11B. An extension portion 142B is provided on an end portion on the right side of the front outer wall 111B of the lower box 11B. Each of the extension portions 141B and 142B extends upward. As shown in FIG. 2 and FIG. 3, a protrusion portion 141A is provided on an end portion on the left side of the front outer wall 111A of the upper box 11A. A protrusion portion 142A is provided on an end portion on the right side of the front outer wall 111A of the upper box 11A. Each of the protrusion portions 141A and 142A protrudes in a direction orthogonal to the front outer wall 111A. In the closed state of the box 11, the protrusion portion 141A engages with the extension portion 141B, and the protrusion portion 142A engages with the extension portion 142B. The protrusion portions 141A and 142A, and the extension portions 141B and 142B hold the box 11 in the closed state, and regulate the box 11 from moving to the open state.

Connector connection portions 19A and 19B are provided on the right outer wall 112B of the lower box 11B. The connector connection portions 19A and 19B are recessed toward the inside of the box 11. The connector connection portions 19A and 19B are aligned in the up-down direction. Through holes (not shown in the drawings) are provided in left side surfaces of each of the connector connection portions 19A and 19B. By a user plugging a power source connector into the through hole of the connector connection portion 19A from outside, the power source connector can be connected to printing equipment 20 (refer to FIG. 3) housed in the box 11. By the user plugging a USB connector into the through hole of the connector connection portion 19B from outside, the USB connector can be connected to the printing equipment 20.

Figure 4:
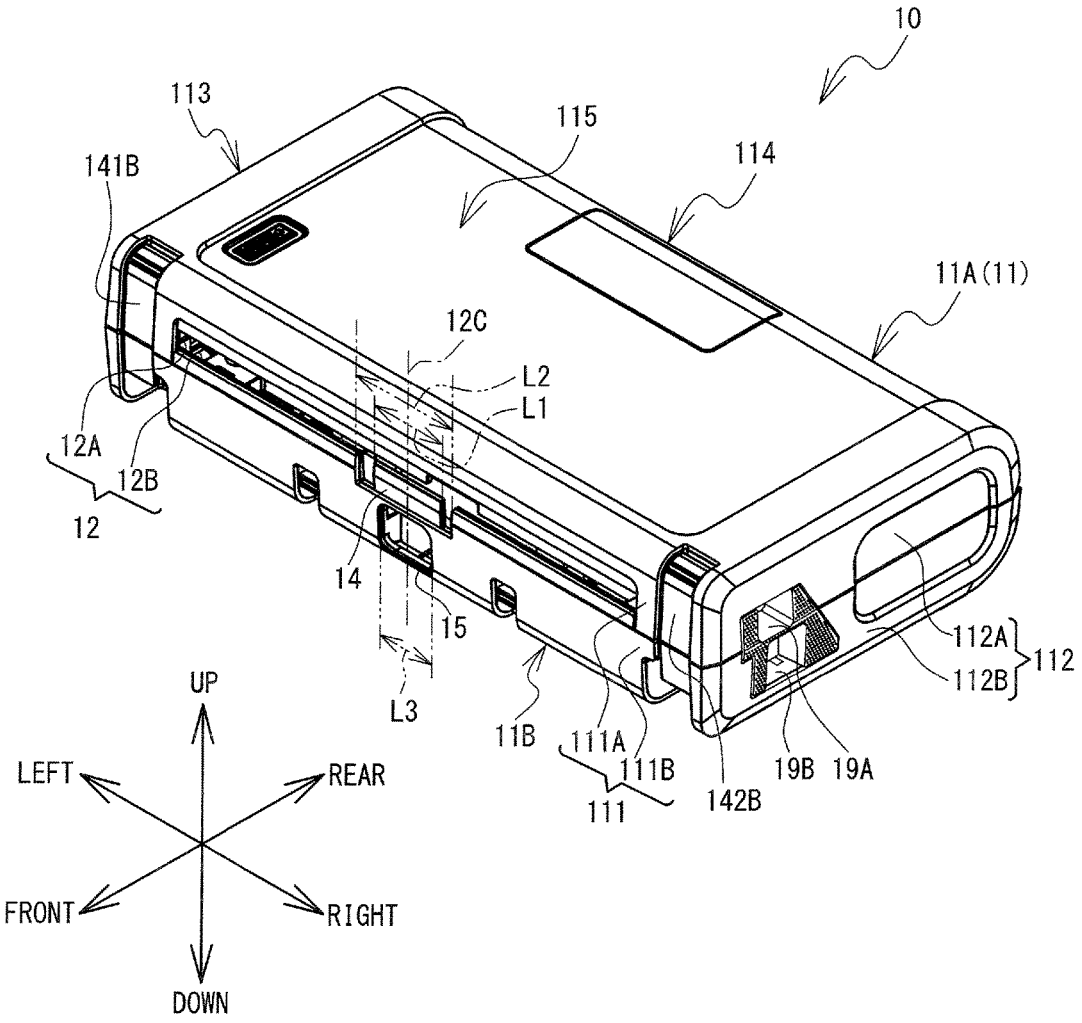
FIG. 4 is a perspective view of the printing equipment housing box 10 with a cover 50 and a holding mechanism 70 removed.

As shown in FIG. 1 to FIG. 4, a concave portion 12A is provided in the front outer wall 111A of the upper box 11A. When the box 11 is in the closed state (refer to FIG. 1 and FIG. 4), the concave portion 12A is provided on a lower side end portion of the front outer wall 111A. The concave portion 12A is recessed upward. A convex portion 12B is provided on the front outer wall 111B of the lower box 11B. When the box 11 is in the closed state (refer to FIG. 1 and FIG. 4), the convex portion 12B is provided on an upper side end portion of the front outer wall 111B. The convex portion 12B protrudes upward. As shown in FIG. 1 and FIG. 4, when the box 11 is in the closed state, the convex portion 12B fits into the concave portion 12A. A length of the concave portion 12A in the up-down direction is longer than a length of the convex portion 12B in the up-down direction. A length of the concave portion 12A in the left-right direction is substantially the same as a length of the convex portion 12B in the left-right direction. A gap between the concave portion 12A and the convex portion 12B, which is formed when the concave portion 12A and the convex portion 12B are fitted together, forms a paper discharge port 12 in the front outer wall 111 of the box 11. The paper discharge port 12 extends along the front outer wall 111 in the left-right direction. The paper discharge port 12 penetrates through the front outer wall 111 in the front-rear direction.

Figure 5:
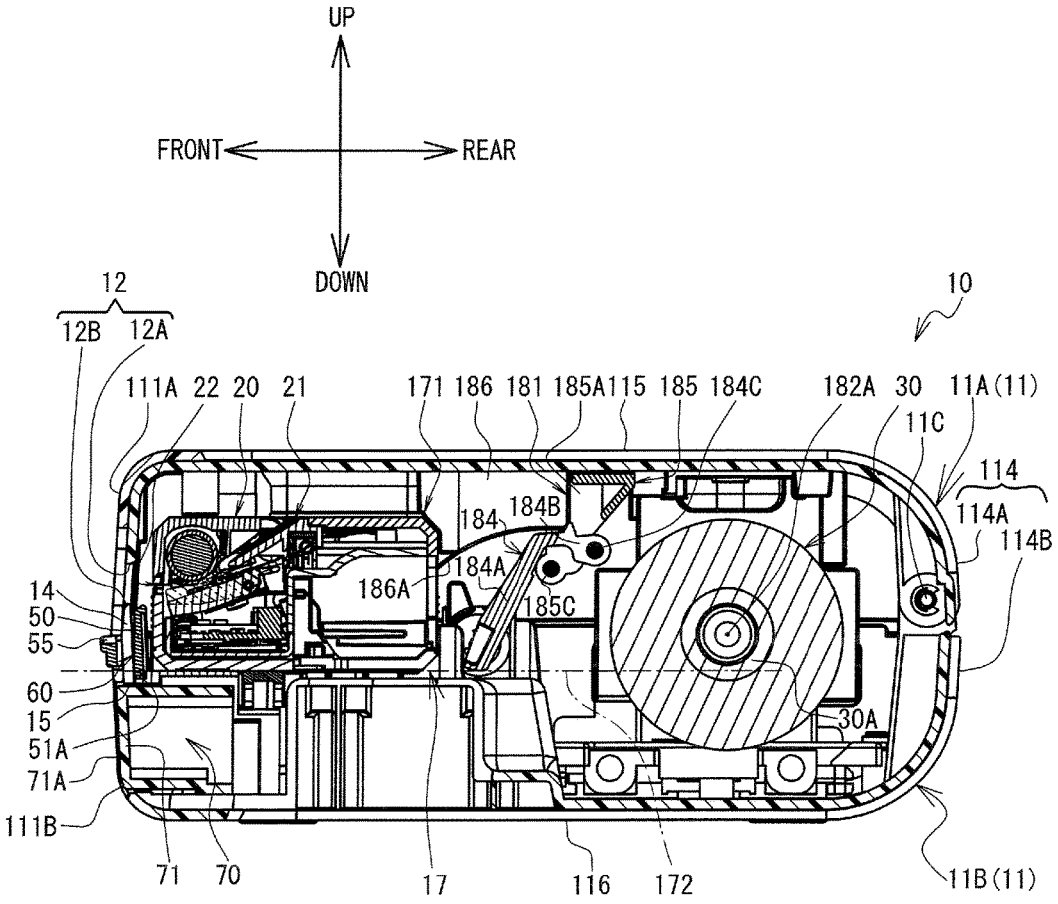
FIG. 5 is a cross-sectional view as seen in the direction of arrows along a line V-V shown in FIG. 1.

As shown in FIG. 1, a cover 50 is provided inside the box 11. The cover 50 can move in substantially the up-down direction along an inner surface of the front outer wall 111B of the lower box 11B. When the cover 50 has moved substantially to the upper side, it is possible to cover the paper discharge port 12. Further, as shown in FIG. 5, when the cover 50 has moved substantially to the lower side, it is possible to open the paper discharge port 12. Below, a position of the cover 50 in which the cover 50 has moved substantially to the upper side and has covered the paper discharge port 12 is referred to as a "closed position." A position of the cover 50 in which the cover 50 has moved substantially to the lower side and has opened the paper discharge port 12 is referred to as an "open position." The cover 50 will be described in more detail later.

As shown in FIG. 1, slits 13A and 13B are provided in the front outer wall 111B of the lower box 11B. The slits 13A and 13B extend downward from an end portion on the upper side of the convex portion 12B. The slit 13A is provided to the left of a center 12C in the left-right direction of the paper discharge port 12. The slit 13B is provided to the right of the center 12C. The slits 13A and 13B are separated in the left-right direction. A width of each of the slits 13A and 13B in the left-right direction is the same. The slits 13A and 13B communicate with the paper discharge port 12. Hereinafter, the slits 13A and 13B are sometimes referred to collectively as the "slits 13."

A distance from an end portion of the slit 13A on the center 12C side to the center 12C, and a distance from an end portion of the slit 13B on the center 12C side to the center 12C are the same, in the left-right direction. A distance from an end portion of the slit 13A on a side opposite to the center 12C side to the center 12C and a distance from an end portion of the slit 13B on a side opposite to the center 12C side to the center 12C are the same, in the left-right direction. The slits 13A and 13B are disposed symmetrically on the left and right sides of the center 12C. Hereinafter, a distance between the respective end portions of the slits 13A and 13B on the center 12C side is referred to as a "distance L1." A distance between the respective end portions of the slits 13A and 13B on the side opposite to the center 12C side is referred to as a "distance L2."

Of the front outer wall 111B of the lower box 11B, a section sandwiched on both sides in the left-right direction by the slits 13A and 13B is referred to as a "port cover section 14." Of the front outer wall 111B of the lower box 11B, a box hole portion 15 is formed below the port cover section 14. The box hole portion 15 is a through hole that penetrates through the front outer wall 111B in the front-rear direction. Hereinafter, a distance of the box hole portion 15 in the left-right direction is referred to as a "distance L3." The distance L3 is smaller than the distance L2.

As shown in FIG. 1, protrusion portions 552 (refer to FIG. 6) of a handle 55 provided on the cover 50 protrude to the outside from the inside of the box 11, via the slits 13. The handle 55 is operated by the user in order to move the cover 50 in substantially the up-down direction between the closed position and the open position. A button 71 (refer to FIG. 10) of a holding mechanism 70 is inserted into the box hole portion 15. The button 71 is operated by the user in order to release a state in which the cover 50 is regulated from moving from the open position to the closed position. The handle 55 and the holding mechanism 70 will be described in more detail later.

<Equipment Housing Portion 171, Roll Housing Portion 181>

As shown in FIG. 2 and FIG. 5, a pedestal 17 is provided in a section on a front side of an interior space of the box 11. The pedestal 17 has a plate-shaped member 17A and a protrusion member 17B. The plate-shaped member 17A is separated from the lower outer wall 116, above the lower outer wall 116. The plate-shaped member 17A extends horizontally. The protrusion member 17B protrudes upward from the lower outer wall 116. The plate-shaped member 17A and the protrusion member 17B form a virtual placement surface 172 (refer to FIG. 5) that extends horizontally along respective end portions on the upper side of the plate-shaped member 17A and the protrusion member 17B. The placement surface 172 is disposed below the upper side end portion of the convex portion 12B of the lower box 11B, and slightly above the upper side end portion of the box hole portion 15. Below, of the interior space of the box 11, a space above the pedestal 17 is referred to as an "equipment housing portion 171."

As shown in FIG. 3 and FIG. 5, the printing equipment 20 is housed in the equipment housing portion 171. The printing equipment 20 is equipment that is able to perform the printing, using a thermal ink-transfer method, onto a print medium 31 that will be described later. A shape of the printing equipment 20 is a substantial box shape that is long in the left-right direction. The printing equipment 20 is placed on the top side of the pedestal 17. The printing equipment 20 has a paper feed portion 21 and a paper discharge portion 22. The paper feed portion 21 is provided on an upper side surface of the printing equipment 20. The paper feed portion 21 is a slit-shaped opening used to take the print medium 31 into the interior. The paper feed portion 21 extends in the left-right direction. The paper discharge portion 22 is provided on a front side surface of the printing equipment 20. The paper discharge portion 22 is a slit-shaped opening used to discharge the printed print medium 31 to the outside. The paper discharge portion 22 extends in the left-right direction.

As shown in FIG. 5, the paper discharge portion 22 is disposed to the rear of the paper discharge port 12 of the box 11. The paper discharge portion 22 is disposed, in the up-down direction, above the upper side end portion of the convex portion 12B of the front outer wall 111B of the lower box 11B, and below the upper side end portion of the concave portion 12A of the front outer wall 111A of the upper box 11A. The printed print medium 31 that is discharged from the paper discharge portion 22 is discharged to the outside of the box 11 via the paper discharge port 12.

As shown in FIG. 2, of the interior space of the box 11, a roll housing portion 181 is formed to the rear of the equipment housing portion 171. Roll holding portions 182 and 183, and guiding members 184 and 185 are provided in the roll housing portion 181. The roll holding portion 182 is disposed on the right side of the left outer wall 113B of the lower box 11B. The roll holding portion 182 has a cylindrical protrusion portion 182A that protrudes to the right side. The roll holding portion 183 is disposed on the left side of the right outer wall 112B of the lower box 11B. The roll holding portion 183 has a cylindrical protrusion portion 183A that protrudes to the left side. The roll holding portions 182 and 183 clamp, from both sides in the left-right direction, a roll 30 (refer to FIG. 3) on which the print medium 31 is wound. The protrusion portions 182A and 183A enter into the inside of a core 30A (refer to FIG. 5) of the roll 30, at both of end portions in the left-right direction. The protrusion portions 182A and 183A rotatably hold the roll 30. The roll 30 is housed in the roll housing portion 181 in a state in which a rotation direction of the roll 30 is clockwise in a right side surface view when the print medium 31 is fed out.

As shown in FIG. 5, the protrusion portion 182A of the roll holding portion 182 is disposed further to the upper side, in the up-down direction than the placement surface 172 of the pedestal 17. An end portion on the lower side of the core 30A of the roll 30 held by the protrusion portions 182A and 183A is disposed slightly further to the lower side, in the up-down direction, than the placement surface 172.

As shown in FIG. 2 and FIG. 3, the guiding member 184 is disposed on the front side of the roll housing portion 181. As shown in FIG. 5, the guiding member 184 has extension members 184A and 184B, a rod member 184C, and a spring that is not shown in the drawings. The extension member 184A is a plate-shaped member that is substantially rectangular and is long in the left-right direction. In the lower box 11B, the extension member 184A extends upward and toward the rear from a position to the rear of the equipment housing portion 171 and above the placement surface 172. The extension member 184A is rotatably supported, with respect to the lower box 11B, by a shaft that extends in the left-right direction. The extension member 184A is urged in an anti-clockwise direction in a right side surface view, by the spring that is not shown in the drawings.

The extension member 184B extends upward and to the rear from end portions on both sides, in the left-right direction, on the rear side of the extension member 184A. A leading end portion of the extension member 184B supports the rod member 184C. The rod member 184C is a rod-shaped member whose cross-sectional shape is circular. The rod member 184C extends in the left-right direction. End portions on both sides of the rod member 184C in the left-right direction are supported by the extension member 184B. The rod member 184C is disposed further to the front side in the front-rear direction, and further to the upper side in the up-down direction than the protrusion portions 182A and 183A of the roll holding portions 182 and 183.

As shown in FIG. 2 and FIG. 3, the guiding member 185 is provided on the upper outer wall 115 of the box 11. The guiding member 185 has extension members 185A and 185B, and a rod member 185C. The extension member 185A extends from the vicinity of an end portion on the left side of the upper outer wall 115, toward the inside of the box 11. The extension member 185B extends from the vicinity of an end portion on the right side of the upper outer wall 115, toward the inside of the box 11. As shown in FIG. 5, when the box 11 is in the closed state, of the upper outer wall 115, the extension members 185A and 185B extend further to the front side than the roll holding portions 182 and 183 in the front-rear direction, and further to the rear side than a section at which the extension member 184A of the guiding member 184 is connected to the lower box 11B. End portions on the lower sides of the extension members 185A and 185B support the rod member 185C, from both sides in the left-right direction. The rod member 185C is a rod-shaped member whose cross-sectional shape is circular. The rod member 185C extends in the left-right direction. As shown in FIG. 2 and FIG. 3, when the box 11 is in the open state, the rod member 184C of the guiding member 184 and the rod member 185C of the guiding member 185 are separated from each other.

A guide member 186 is provided on the upper outer wall 115 of the box 11. The guide member 186 is provided to the left side of the upper outer wall 115, and further to the front side than the guiding member 185. The guide member 186 is a plate-shaped member. Each of side surfaces of the guide member 186 is oriented in the left-right direction. A lower side end portion 186A of the guide member 186 is curved in a substantial arc shape.

In the course of changing from the open state to the closed state of the box 11, the end portion 186A of the guide member 186 comes into contact with the upper side end portion of the extension member 184A of the guiding member 184. The guide member 186 causes the upper side end portion of the extension member 184A to move downward and to the rear, along the end portion 186A. The guiding member 184 rotates in the clockwise direction, in a right side surface view, around a section at which it is connected to the lower box 11B in resistance to the urging force of the spring. As shown in FIG. 5, when the box 11 is in the closed state, the rod member 184C of the guiding member 184, and the rod member 185C of the guiding member 185 come close to each other. The rod member 185C is disposed to the front and lower side of the rod member 184C.

An example will be given of a case in which the roll 30 has been set by the user on the roll holding portions 182 and 183 when the box 11 is in the open state. In this case, the print medium 31 that has been fed out from the lower side of the roll 30 by the user is caused to pass the rear side and the upper side of the rod member 184C of the guiding member 184. A leading end of the print medium 31 is inserted into the paper feed portion 21 of the printing equipment 20.

In the above-described state, the box 11 is closed by the user. The rod member 185C of the guiding member 185 comes close, from the rear upper side, to the rod member 184C. By the guiding member 184 coming into contact with the end portion 186A of the guide member 186, the guiding member 184 rotates in the clockwise direction in a right side surface view. The rod member 184C moves past the upper side of the rod member 185C and to the rear side of the rod member 185C. The print medium 31 moves to the rear side in accordance with the movement of the rod member 184C, and comes into contact with the rod member 185C at a section further to the lower side than a section in contact with the rod member 184C. The print medium 31 is curved toward the front side at the section of contact with the rod member 185C.

When the box 11 is in the closed state, the print medium 31 extends from the lower side of the roll 30 toward the front side of the rod member 185C, comes into contact with the rod member 185C and curves to the rear side, and then extends past the upper side of the rod member 185C and the lower side of the rod member 184C to the rear side. Further, the print medium 31 comes into contact with the rod member 184C and curves to the front side, extends past the upper side of the rod member 184C to the front side, and reaches the paper feed portion 21 of the printing equipment 20.

The print medium 31 that has just been fed out from the roll 30 is still curled due as a result of being wound on the roll 30. To deal with this curl, the guiding members 184 and 185 cause the print medium 31 fed out from the roll 30 to curve using the rod members 184C and 185C, thus causing the print medium 31 to curve in a direction opposite to a curve direction of the curl in the print medium 31. Specifically, the guiding members 184 and 185 cause a direction in which the leading end of the print medium 31 fed out from the roll 30 is oriented to change from the rear side to the front side, at a section that comes into contact with the rod member 184C. Of the print medium 31, a curve direction of the section that comes into contact with the rod member 184C and curves is a reverse direction to the curve direction of the curl. Of the print medium 31, a radius of curvature of the curved section that comes into contact with the rod member 184C is smaller than a radius of curvature of the print medium 31 when it is wound on the roll 30. Thus, the curl of the print medium 31 is restored in accordance with coming into contact with the rod member 184C and being curved.

<Cover 50>

Figure 6:
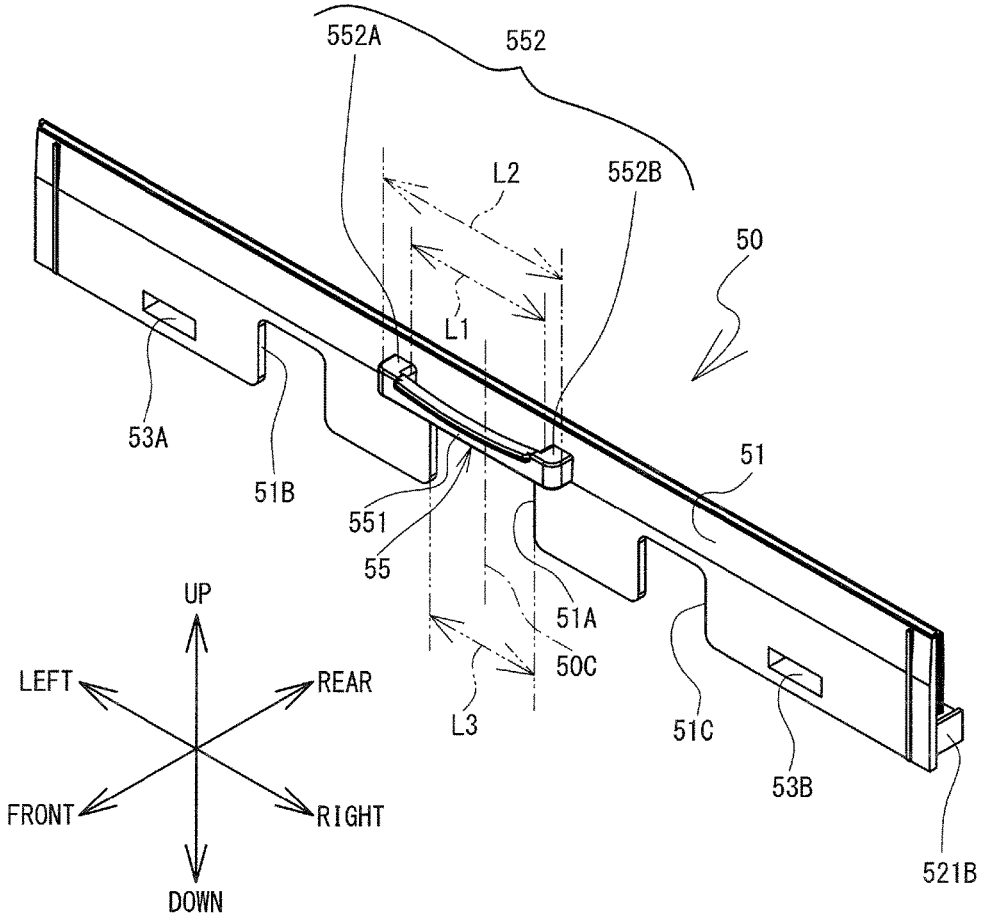
FIG. 6 is a perspective view of the cover 50.
Figure 7:
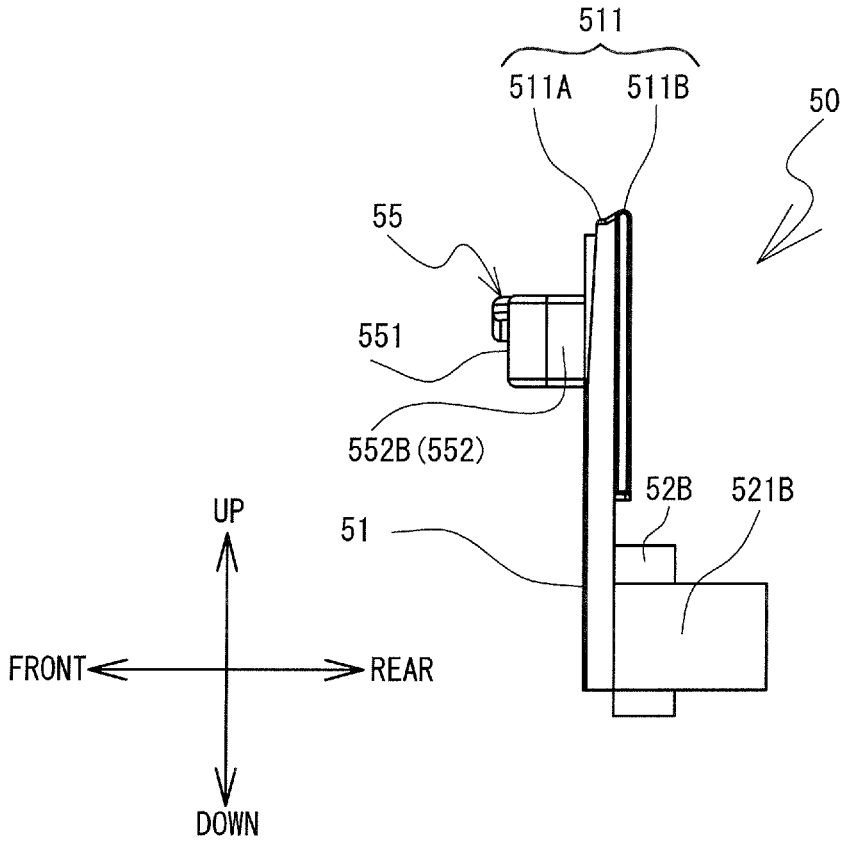
FIG. 7 is a right side view of the cover 50.

As shown in FIG. 6, the cover 50 has a plate-shaped member 51. The plate-shaped member 51 is a rectangular plate-shaped member that is long in the left-right direction. Front and rear surfaces of the plate-shaped member 51 are respectively oriented in the front-rear direction. Lengths of the plate-shaped member 51 in the up-down direction and in the left-right direction are respectively longer than lengths of the paper discharge port 12 (refer to FIG. 1) in the up-down direction and in the left-right direction. As shown in FIG. 7, an upper side end portion of the plate-shaped member 51 (hereinafter referred to as an "engagement portion 511") has a first portion 511A and a second portion 511B. The first portion 511A extends substantially horizontally from a front side end portion toward the rear side. The second portion 511B extends from a rear side end portion of the first portion 511A upward and toward the rear side.

As shown in FIG. 6, the handle 55 is provided on the plate-shaped member 51. The handle 55 has a bridge portion 551, and protrusion portions 552A and 552B. The protrusion portion 552A extends toward the front side from further to the upper side than a center of the plate-shaped member 51 in the up-down direction, and from further to the left side than a center 50C in the left-right direction. The protrusion portion 552B extends toward the front side from further to the upper side than the center of the plate-shaped member 51 in the up-down direction, and from further to the right side than the center 50C in the left-right direction. The bridge portion 551 is provided in a straight line between front side end portions of each of the protrusion portions 552A and 552B.

A width of each of the protrusion portions 552A and 552B in the left-right direction is substantially the same as a width in the left-right direction of each of the slits 13A and 13B (refer to FIG. 4). A distance between the protrusion portion 552A and 552B is substantially the same as a distance between the slits 13A and 13B. More specifically, a distance between the end portions of each of the protrusion portions 552A and 552B on the center 50C side is the same as the distance L1 between the end portions of each of the slits 13A and 13B on the center 12C side (refer to FIG. 4). A distance between end portions of each of the protrusion portions 552A and 552B on the opposite side to the center 50C is the same as the distance L2 between the end portions of each of the slits 13A and 13B on the opposite side to the center 12C (refer to FIG. 4). A distance between the protrusion portion 552A and the center 50C, and a distance between the protrusion portion 552B and the center 50C are the same in the left-right direction. Thus, a position of a center in the left-right direction between the protrusion portions 552A and 552B and a position of the center in the left-right direction of the plate-shaped member 51 respectively match each other. The protrusion portions 552A and 552B are disposed symmetrically to the right and the left with respect to the center 50C. Hereinafter, the protrusion portions 552A and 552B are sometimes collectively referred to as the "protrusion portions 552."

Cover open portions 51A, 51B and 51C are formed in the lower side end portion of the plate-shaped member 51. The cover open portions 51A, 51B and 51C form openings by being recessed upward. The cover open portion 51A is provided in a position overlapping the center 50C. The cover open portion 51B is provided further to the left side than the center 50C. The cover open portion 51C is provided further to the right side than the center 50C. The cover open portion 51A is disposed below a section sandwiched from the left and right directions by the protrusion portions 552A and 552B of the handle 55. A left side end portion of the cover open portion 51A is disposed further to the right side than the right side end portion of the protrusion portion 552A in the left-right direction. A right side end portion of the cover open portion HA is disposed further to the left side than the left side end portion of the protrusion portion 552B in the left-right direction. A distance in the left-right direction of the cover open portion HA is smaller than the distance L2 between each of the end portions on the center 50C side of the protrusion portions 552A and 552B. The distance in the left-right direction of the cover open portion HA is the same as the distance L3 in the left-right direction of the box hole portion 15 (refer to FIG. 4).

Figure 8:
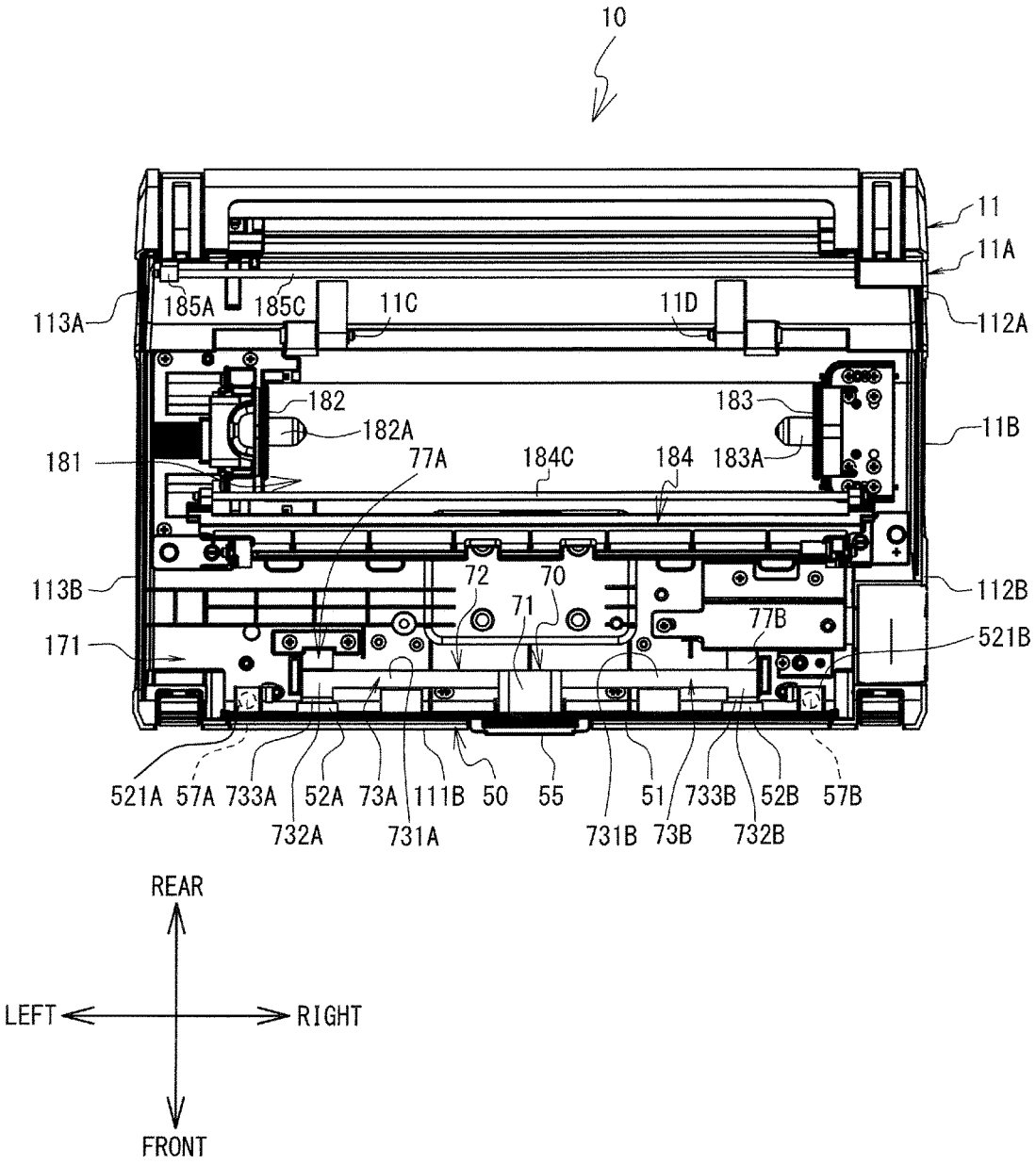
FIG. 8 is a plan view of the printing equipment housing box 10 when the box 11 is in the open state.

As shown in FIG. 8, a protrusion portion 52A, which protrudes to the rear, is provided in a section between the left side end portion of the plate-shaped member 51 and the cover open portion 51B. As shown in FIG. 7 and FIG. 8, a protrusion portion 52B, which protrudes to the rear, is provided in a section between the right side end portion of the plate-shaped member 51 and the cover open portion 51C. The protrusion portions 52A and 52B extend from positions lower than the center, in the up-down direction, of the plate-shaped member 51. As shown in FIG. 6, a hole portion 53A is formed that penetrates the plate-shaped member 51 and the protrusion portion 52A in the front-rear direction. A hole portion 53B is formed that penetrates the plate-shaped member 51 and the protrusion portion 52B in the front-rear direction. The hole portions 53A and 53B are rectangular long holes that are long in the left-right direction.

As shown in FIG. 8, a protrusion portion 521A, which protrudes to the rear, is provided on the left side of the protrusion portion 52A, on the plate-shaped member 51. As shown in FIG. 7 and FIG. 8, a protrusion portion 521B, which protrudes to the rear, is provided on the right side of the protrusion portion 52B, on the plate-shaped member 51. A length of each of the protrusion portions 521A and 521B in the front-rear direction is longer than a length of each of the protrusion portions 52A and 52B in the front-rear direction. As shown in FIG. 8, a first urging member 57A is provided below the protrusion portion 521A. The first urging member 57A is in contact with a lower side surface of the protrusion portion 521A. A first urging member 57B is provided below the protrusion portion 521B of the cover 50. The first urging member 57B is in contact with a lower side surface of the protrusion portion 521B. The first urging members 57A and 57B are coil springs. The first urging members 57A and 57B urge the cover 50 upward from the open position toward the closed position.

Figure 9:
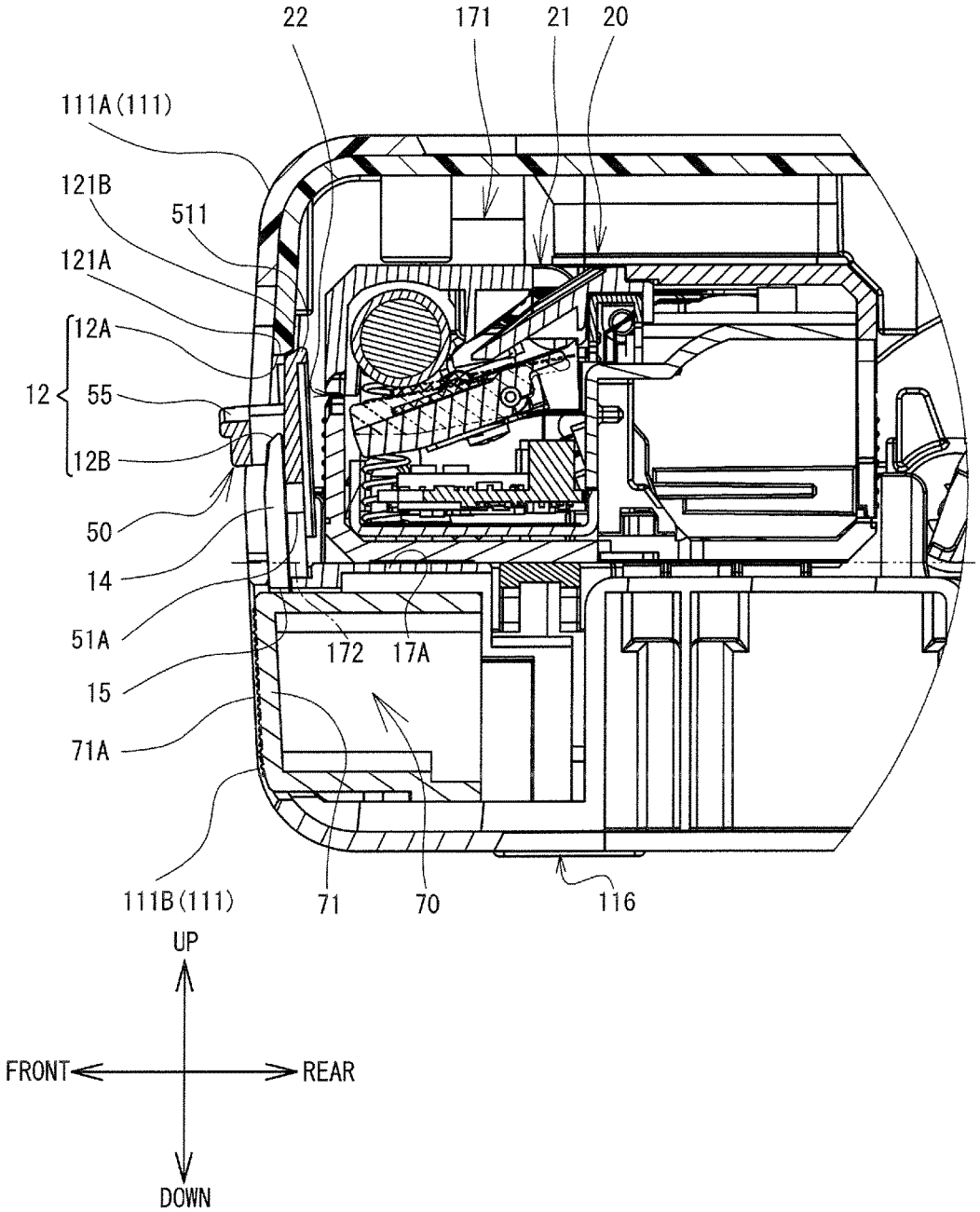
FIG. 9 is a partial exploded view of the cross-sectional view as seen in the direction of the arrows along the line V-V shown in FIG. 1.

As shown in FIG. 9, the cover 50 is disposed along an inner side surface of the front outer wall 111B of the lower box 11B of the box 11. Further, the cover 50 is disposed in front of the equipment housing portion 171. In other words, the cover 50 is disposed between the front outer wall 111B and the equipment housing portion 171. The upper side end portion of the inner side surface of the front outer wall 111B is slightly inclined to the front with respect to the up-down direction. As a result, the engagement portion 511 of the plate-shaped member 51 of the cover 50 is also slightly inclined to the front, in relation to the up-down direction. The cover 50 can move along the inner side surface of the front outer wall 111B in the slightly inclined direction with respect to the up-down direction. More specifically, the cover 50 can move between an upper front side and a lower rear side. The cover 50 is disposed in the closed position by moving to the upper front side, and is disposed in the open position by moving to the lower rear side.

As shown in FIG. 1 and FIG. 9, when the cover 50 moves toward the upper front side, the engagement portion 511 of the cover 50 moves toward the outside of the box 11 on the upper side. In a state in which the cover 50 is disposed in the closed position, the plate-shaped member 51 covers the paper discharge port 12 from the inside. The protrusion portions 552 of the handle 55 are disposed on the inside of the paper discharge port 12, and above the slits 13. A lower side section of the cover open portion 51A (refer to FIG. 6)

overlaps with an upper side section of the box hole portion 15 disposed to the front. An upper side section of the cover open portion 51A overlaps with a section of the port cover section 14 disposed to the front.

As shown in FIG. 9, the engagement portion 511 on the upper side of the plate-shaped member 51 comes into contact with and engages with the upper side end portion of the concave portion 12A of the front outer wall 111A of the upper box 11A, from below. The first portion 511A (refer to FIG. 7) of the engagement portion 511 comes into contact with a lower side surface 121A of the upper side end portion of the concave portion 12A. The second portion 511B (refer to FIG. 7) of the engagement portion 511 comes into contact with an intersection section of the upper side end portion of the concave portion 12A, at which the lower side surface 121A and a rear side surface 121B intersect each other.

When the cover 50 moves from the closed position to the lower rear side, the protrusion portion 552A of the handle 55 enters into the slit 13A from above, and moves downward along the slit 13A. The protrusion portion 552B of the handle 55 enters into the slit 13B from above, and moves downward along the slit 13B. As shown in FIG. 5, when the cover 50 is disposed in the open position, the cover open portion 51A overlaps, across its whole area in the up-down direction, with the box hole portion 15 disposed to the front. The engagement portion 511 of the plate-shaped member 51 is disposed further to the lower side, in the up-down direction, than the upper side end portion of the convex portion 12B that forms the paper discharge port 12. The paper discharge port 12 is not covered by the plate-shaped member 51 and is open.

<Holding Mechanism 70>

Figure 10:
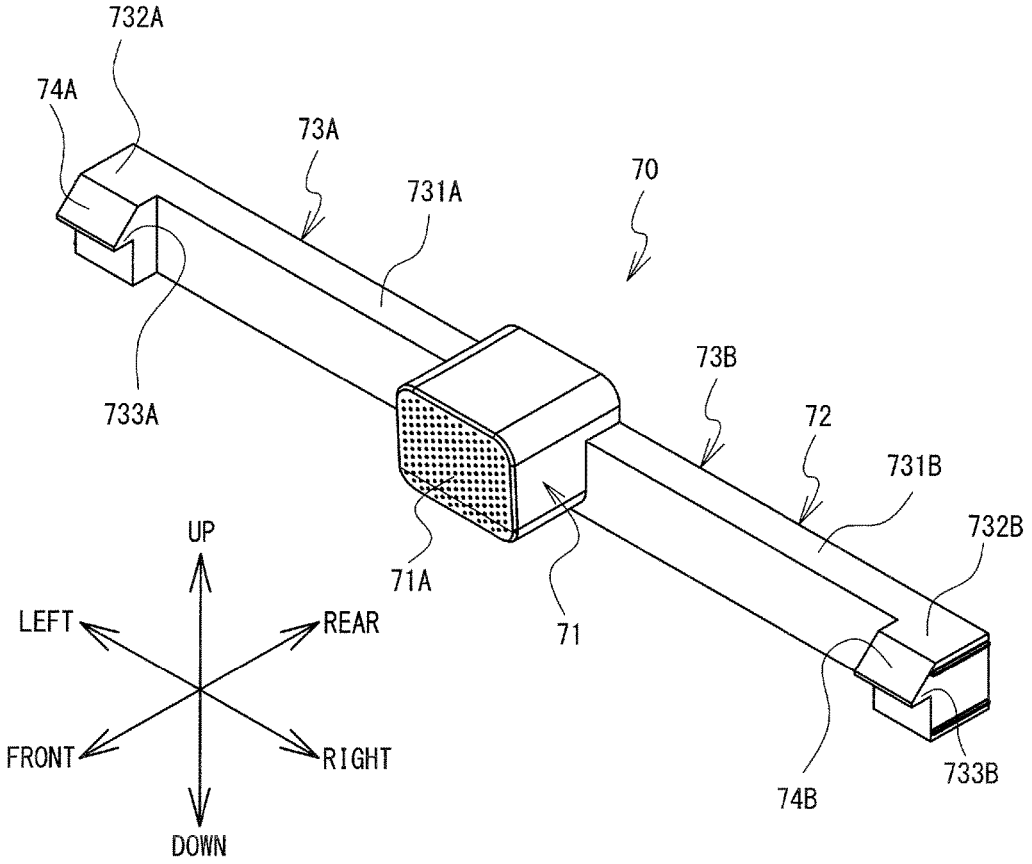
FIG. 10 is a perspective view of the holding mechanism 70.

As shown in FIG. 10, the holding mechanism 70 has the button 71 and the holding member 72. The button 71 is a substantially square column member. The button 71 extends in the front-rear direction. Corners of side surfaces of the button 71 are curved. A plurality of indentations are provided on a front side surface 71A of the button 71. The holding member 72 has a left holding member 73A and a right holding member 73B. The left holding member 73A is coupled to the left side of the button 71. The right holding member 73B is coupled to the right side of the button 71. The left holding member 73A and the right holding member 73B are symmetrical to each other in the left-right direction, on either side of the button 71. Hereinafter, the left holding member 73A will be explained in more detail and an explanation of the right holding member 73B will be simplified.

The left holding member 73A has extension portions 731A and 732A, and a regulating portion 733A. The extension portion 731A extends toward the left, from a rear side end portion of a left side surface of the button 71. The extension portion 732A extends toward the front, from a left side end portion of the extension portion 731A. Each of the extension portions 731A and 731B has a square column shape. The regulating portion 733A extends toward the front from an upper side end portion of a front side surface of the extension portion 732A. An upper side surface of the regulating portion 733A is inclined diagonally downward toward the front. Hereinafter, the upper side surface of the regulating portion 733A is referred to as an "inclined surface 74A."

The right holding member 73B has extension portions 731B and 732B, and a regulating portion 733B. The extension portions 731B and 732B, and the regulating portion 733B respectively correspond to the extension portions 731A and 732A, and the regulating portion 733A of the left holding member 73A. An upper side surface of the regulating portion 733B corresponds to the inclined surface 74A of the left holding member 73A. Hereinafter, the upper side surface of the regulating portion 733B is referred to as an "inclined surface 74B."

As shown in FIG. 8, the holding mechanism 70 is disposed inside the front outer wall 111B of the lower box 11B. As shown in FIG. 9, the holding mechanism 70 is disposed below the plate-shaped member 17A of the pedestal 17. As shown in FIG. 8, a length in the left-right direction of the holding mechanism 70 (namely, a length between a left side end of the left holding member 73A and a right side end of the right holding member 73B) is the same as a length between a left side end of the hole portion 53A (refer to FIG. 6) of the cover 50 and a right side end of the hole portion 53B (refer to FIG. 6). A length in the left-right direction of the regulating portion 733A is the same as a length in the left-right direction of the hole portion 53A. A length in the left-right direction of the regulating portion 733B is the same as a length in the left-right direction of the hole portion 53B.

As shown in FIG. 9, a cross-sectional shape of the button 71 is the same as a shape of the box hole portion 15. The button 71 is disposed below the bridge portion 551 of the handle 55. The bridge portion 551 of the handle 55 and the button 71 are aligned in the up-down direction. A center of the button 71 in the left-right direction is aligned with the center 12C, in the left-right direction, of the paper discharge port 12, and with the center 50C, in the left-right direction, of the plate-shaped member 51 of the cover 50.

The holding mechanism 70 can move in the front-rear direction. Hereinafter, a position of the holding mechanism 70 and the button 71 when the holding mechanism 70 has moved furthest to the front is referred to as a "first position." A position of the holding mechanism 70 and the button 71 when the holding mechanism 70 has moved furthest to the rear is referred to as a "second position." As shown in FIG. 8, a second urging member 77A is provided to the rear of the extension portion 732A of the holding mechanism 70. The second urging member 77A is in contact with a rear side surface of the extension portion 732A. A second urging member 77B is provided to the rear of the extension portion 732B of the holding mechanism 70. The second urging member 77B is in contact with a rear side surface of the extension portion 732B. The second urging members 77A and 77B are coil springs. The second urging members 77A and 77B urge the holding mechanism 70 to the front, from the second position toward the first position.

When the holding mechanism 70 has moved to the first position due to the urging force of the second urging members 77A and 77B, the button 71 is inserted into the box hole portion 15 from the inside of the box 11, as shown in FIG. 5 and FIG. 9. The front side surface 71A of the button 71 is disposed in the same plane as an outer side surface of the front outer wall 111B of the lower box 11B. When the cover 50 is disposed in the closed position, the lower side section of the cover open portion 51A overlaps with the upper side section of the box hole portion 15, as shown in FIG. 9. Thus, when the holding mechanism 70 is disposed in the first position, the button 71 is inserted into the section of the cover open portion 51A that overlaps with the box hole portion 15. Namely, the button 71 is inserted into the lower side section of the cover open portion 51A. As shown in FIG. 5, when the cover 50 is disposed in the open position, the cover open portion 51A overlaps, across its whole area in the up-down direction, with the box hole portion 15. Thus, when the holding mechanism 70 is disposed in the first position, the button 71 passes through the section of cover open portion 51A that overlaps with the box hole portion 15. Namely, the button 71 passes through the whole area, in the up-down direction, of the cover open portion 51A.

It should be noted that, although not shown in the drawings, when the holding mechanism 70 and the button 71 have resisted the urging force of the second urging members 77A and 77B and have moved to the second position, the front side surface 71A of the button 71 moves to the rear, as far as a position substantially aligned with the plate-shaped member 51 of the cover 50 in the front-rear direction. In this case, when the cover 50 is disposed in the closed position, the front side surface 71A of the button 71 is disposed in the section of the cover open portion 51A that overlaps with the box hole portion 15. Further, when the cover 50 is disposed in the open position, the front side surface 71A of the button 71 is disposed across the whole area, in the up-down direction, of the section of the cover open portion 51A that overlaps with the box hole portion 15.

<Opening and Closing Operation of the Cover 50>

Figure 11:
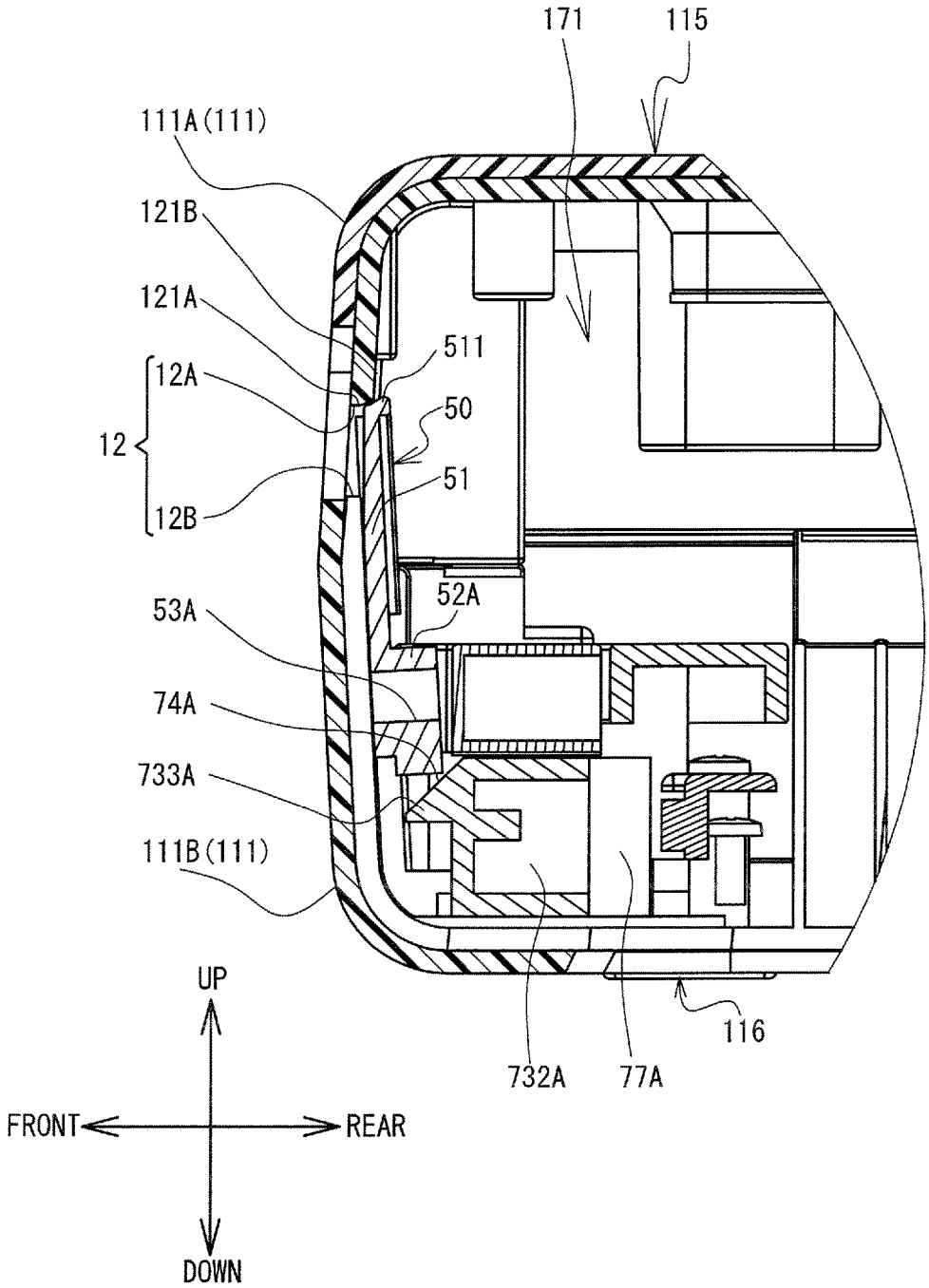
FIG. 11 is a partial exploded view of a cross-sectional view as seen in the direction of arrows along a line XI-XI shown in FIG. 1, and is a view showing a state in which the cover 50 is disposed in a closed position.

An example will be given of a case in which the cover 50 is disposed in the closed position in accordance with the urging force of the first urging members 57A and 57B, and the holding mechanism 70 and the button 71 are disposed in the first position in accordance with the urging force of the second urging members 77A and 77B. In this case, as shown in FIG. 11, the regulating portion 733A of the holding member 72 is disposed below the protrusion portion 52A of the cover 50. The inclined surface 74A of the regulating portion 733A comes into contact, from below, with the rear side of the lower side end portion of the protrusion portion 52A. Although not shown in the drawings, when the cover 50 is disposed in the closed position, the regulating portion 733B of the holding member 72 is disposed below the protrusion portion 52B of the cover 50. The inclined surface 74B of the regulating portion 733B comes into contact, from below, with the rear side of the lower side end portion of the protrusion portion 52B.

An example will be given of a case in which a force is applied to the cover 50 that is disposed in the closed position, in resistance to the urging force of the first urging member 57A and 57B, in a direction toward the open position. As a specific example of this case, a case will be described in which the bridge portion 551 of the handle 55 is pushed downward by the user. In this case, the lower side end portion of the protrusion portion 52A of the cover 50 moves downward while coming into contact with the inclined surface 74A of the regulating portion 733A. The lower side end portion of the protrusion portion 52B of the cover 50 moves downward while coming into contact with the inclined surface 74B of the regulating portion 733B. In this case, a force in a direction toward the rear acts on the regulating portions 733A and 733B. Thus, the holding mechanism 70 and the button 71 resist the urging force of the second urging members 77A and 77B, and move from the first position toward the second position.

Figure 12:
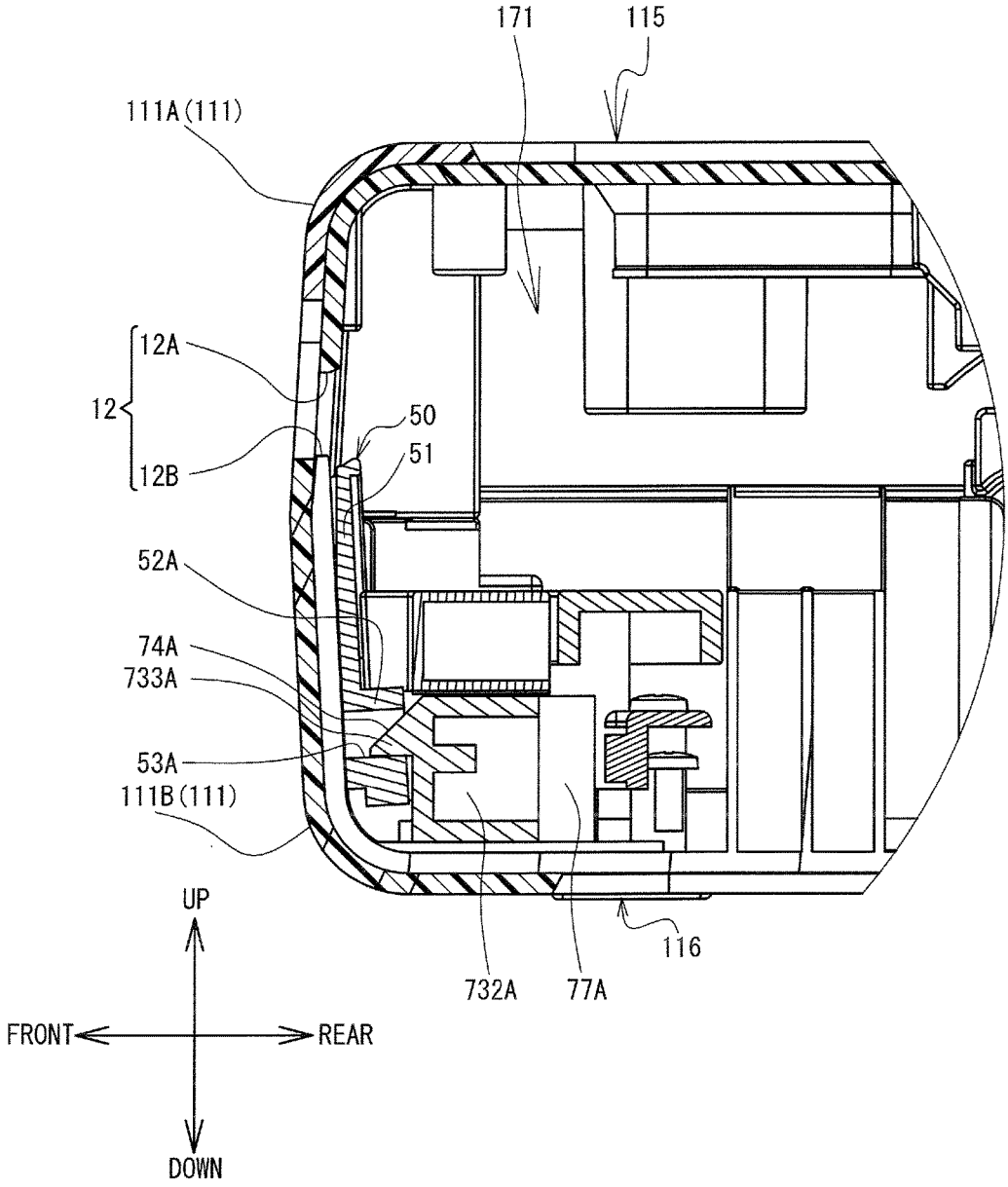
FIG. 12 is a partial exploded view of the cross-sectional view as seen in the direction of the arrows along the line XI-XI shown in FIG. 1, and is a view showing a state in which the cover 50 is disposed in an open position.

When the cover 50 is in the open position, a state is obtained in which the regulating portion 733A of the holding member 72 is disposed to the rear of the protrusion portion 52A of the cover 50, and the regulating portion 733B of the holding member 72 is disposed to the rear of the protrusion portion 52B of the cover 50. In this case, the holding mechanism 70 and the button 71 return to the original first position as a result of the urging force of the second urging members 77A and 77B. As shown in FIG. 12, the regulating portion 733A of the holding member 72 enters, from the rear side, into the hole portion 53A of the protrusion portion 52A. The regulating portion 733B of the holding member 72 enters, from the rear side, into the hole portion 53B of the protrusion portion 52B. The regulating portions 733A and 733B regulate the cover 50 from moving from the open position to the closed position as a result of the urging force of the first urging members 57A and 57B. In this case, the cover 50 is held in a state of being disposed in the open position. Even if the force on the cover 50 in the direction toward the open position is released, the cover 50 does not return to its original closed position.

Figure 13:
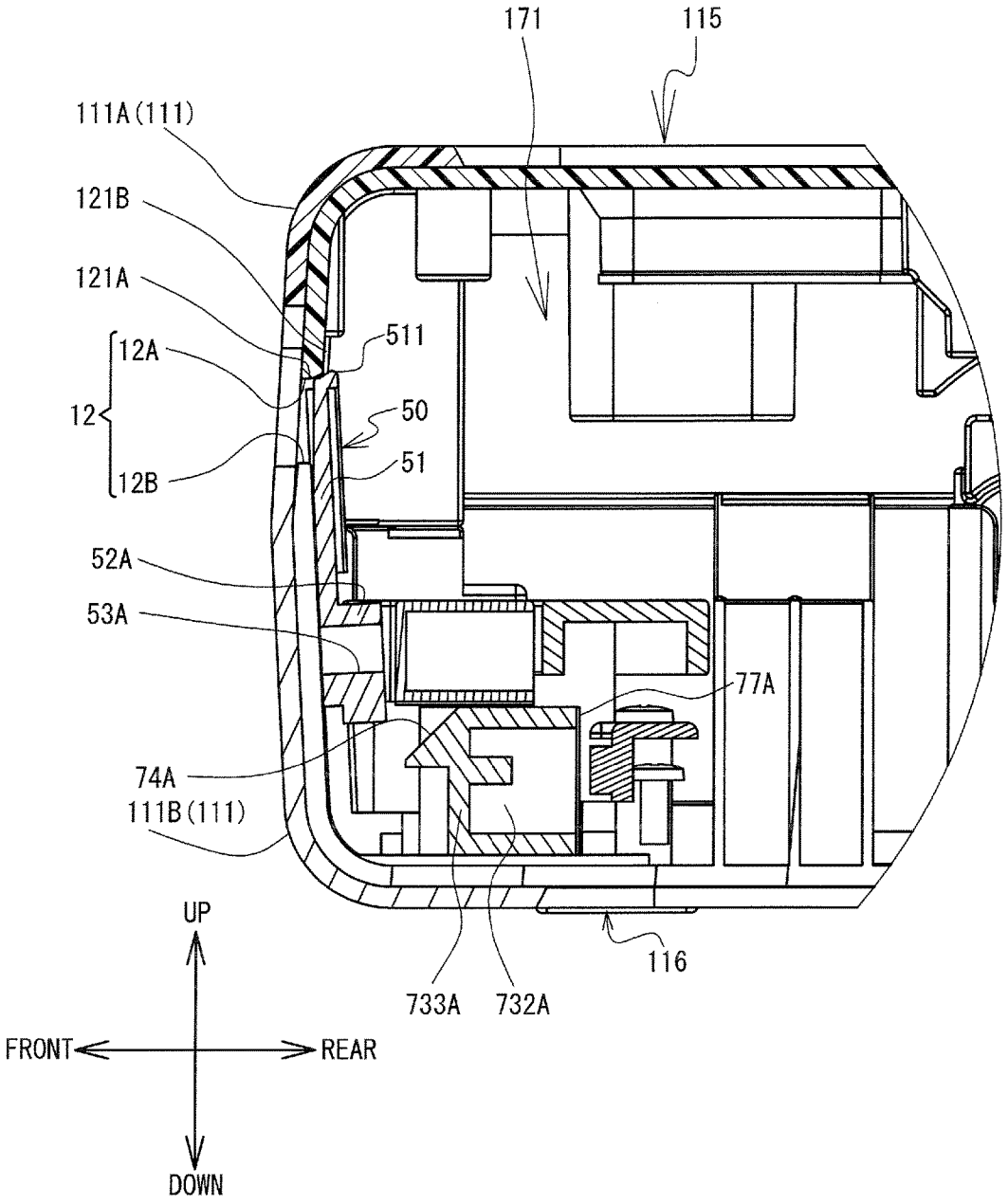
FIG. 13 is a partial exploded view of the cross-sectional view as seen in the direction of the arrows along the line XI-XI shown in FIG. 1, and is a view showing the state in which the cover 50 is in the closed position.

An example will be given of a case in which, when the holding mechanism 70 and the button 71 are disposed in the first position and the cover 50 is held in the open position, a force is applied to the holding mechanism 70 and the button 71 in resistance to the urging force of the second urging members 77A and 77B, in a direction toward the second position. As a specific example of this type of case, a case will be described in which the button 71 is pushed in from the first position toward the second position. In this case, the regulating portion 733A of the holding member 72 moves to the rear, away from the state of being inserted into the hole portion 53A of the protrusion portion 52A. The regulating portion 733A separates from the hole portion 53A of the protrusion portion 52A (refer to FIG. 13). The regulating portion 733B of the holding member 72 moves to the rear, away from the state of being inserted into the hole portion 53B of the protrusion portion 52B. The regulating portion 733B separates from the hole portion 53B of the protrusion portion 52B. The state in which the movement of the cover 50 in the direction toward the closed position is regulated is released in accordance with the movement of the holding mechanism 70 and the button 71 to the second position. As shown in FIG. 13, the cover 50 moves from the open position to the closed position in accordance with the urging force of the first urging members 57A and 57B. The plate-shaped member 51 of the cover 50 covers the paper discharge port 12.

An example will be given of a case in which, from the state shown in FIG. 13, the force applied to the holding mechanism 70 and the button 71 in the direction toward the second position is released. In this case, the holding mechanism 70 and the button 71 move from the second position to the first position due to the urging force of the second urging members 77A and 77B. As shown in FIG. 11, the regulating portion 733A of the holding member 72 is disposed below the protrusion portion 52A of the cover 50. The regulating portion 733B of the holding member 72 is disposed below the protrusion portion 52B of the cover 50.

<Main Effects and Benefits of the Present Disclosure>

As explained above, in the printing equipment housing box 10, the cover 50 disposed inside the box 11 is able to move in substantially the up-down direction along the inner side surface of the front outer wall 111B. The cover 50 thus opens and closes the paper discharge port 12. When the cover 50 is disposed in the closed position, it is possible to inhibit water, dirt, dust or the like from entering inside the box 11 via the paper discharge port 12. In the printing equipment housing box 10, in accordance with the operation of the button 71, the state of holding the cover 50 in the open position is released by the holding member 72. Note that the cover 50 moves inside the box 11 and therefore, even when it has moved to the open position, it does not protrude to the outside from the box 11. As a result, the user does not need to secure a sufficient installation space for the cover 50 in the printing equipment housing box 10. In the printing equipment housing box 10, it is difficult for a force to be applied from the outside to the cover 50 disposed in the open position, and it is thus possible to inhibit the cover 50 from moving due to a force being applied to the cover 50. Thus, when the printing equipment 20 is contained in the box 11, the printing equipment housing box 10 can stably perform printing by the printing equipment 20.

In the above description, the cover open portion 51A of the cover 50 is a necessary configuration in order to avoid the cover 50 coming into contact with the button 71. However, it is necessary to inhibit water, dirt, dust or the like from entering into the box 11 via the cover open portion 51A. The port cover section 14 of the box 11 overlaps partially with the cover open portion 51A when the cover 50 is disposed in the closed position. Therefore, the printing equipment housing box 10 can appropriately inhibit water, dirt, dust or the like from entering into the box 11 via the cover open portion 51A, using the port cover section 14.

In the above description, the regulating portions 733A and 733B of the holding mechanism 70 regulate the movement of the cover 50 from the open position toward the closed position, when the button 71 is disposed in the first position. When the button 71 has moved from the first position to the second position, the regulating portions 733A and 733B release the regulation on the movement of the cover 50 to the closed position. As a result, the user can switch the position of the cover 50 from the open position to the closed position by performing the operation to move the button 71 from the first position to the second position. It should be noted that the bridge portion 551 of the handle 55, and the button 71 are disposed so as to be aligned in the up-down direction. Thus, the user can easily manipulate both the handle 55 and the button 71 using one hand.

In the above description, the first urging members 57A and 57B urge the cover 50 from the open position toward the closed position. The first urging members 57A and 57B can cause the cover 50 to be held in the closed position. Thus, the printing equipment housing box 10 can appropriately inhibit water, dirt, dust or the like from entering into the box 11 via the paper discharge port 12, using the cover 50. In addition, the holding member 72 can easily release the state in which the movement of the cover 50 to the closed position is regulated by the urging force of the first urging members 57A and 57B.

In the above description, the second urging members 77A and 77B urge the holding mechanism 70 and the button 71 from the second position toward the first position. In this case, after an operation has been performed to move the button 71 from the first position to the second position, the second urging members 77A and 77B can return the button 71 to the first position.

In the above description, the center between the protrusion portions 552A and 552B of the handle 55 in the left-right direction matches the center of the plate-shaped member 51 in the left-right direction. In this case, when a downward force is applied to the bridge portion 551 of the handle 55, the force is imparted evenly on the cover 50 in the left-right direction. Thus, the user can cause the cover 50 to move smoothly from the closed position to the open position by applying the downward force on the bridge portion 551 of the handle 55. Further, in the above description, the distance between each of the slits 13A and 13B, and the distance between each of the protrusion portions 552A and 552B of the handle 55 are one of either the distance L1 or the distance L2, and match each other. Thus, the printing equipment housing box 10 can inhibit rattling of the cover 50 in the left-right direction when the protrusion portions 552 move downward along the slits 13.

In the above description, when the cover 50 has moved to the closed position, the engagement portion 511 comes into contact with and engages with the concave portion 12A that forms a part of the paper discharge port 12, from below. Thus, the printing equipment housing box 10 can inhibit water, dirt, dust or the like from entering into the box 11 from a gap between the paper discharge port 12 and the cover 50 when the cover 50 is disposed in the closed position. In addition, in the above description, the cover 50 can move along the inner side of the front outer wall 111B, in a slightly inclined direction with respect to the up-down direction. Specifically, the cover 50 can move between the upper front side to the lower rear side. In this case, the printing equipment housing box 10 can cause the cover 50 to be in appropriately close contact with the paper discharge port 12 from the inside of the box 11. As a result, the cover 50 can even more appropriately inhibit water, dirt, dust or the like from entering into the box 11 via the paper discharge port 12.

In the above description, the placement surface 172 of the equipment housing portion 171 is disposed above the box hole portion 15. Therefore, the printing equipment 20 that is placed on the placement surface 172 and the button 71 are disposed so as to be aligned with each other in the up-down direction. Thus, the printing equipment housing box 10 can inhibit the button 71 and the equipment housing portion 171 from being disposed so as to be aligned in the front-rear direction. As a result, it is possible to inhibit the printing equipment housing box 10 from becoming larger in the front-rear direction, and downsizing of the printing equipment housing box 10 becomes possible.

The lower side end portion of the core 30A of the roll 30 held by the roll holding portions 182 and 183 is disposed slightly below the placement surface 172, in the up-down direction. The print medium 31 that is fed out from the roll 30 traverses from the lower side to the upper side of the placement surface 172, and reaches the paper feed portion 21 of the printing equipment 20 while curving due to the guiding members 184 and 185. In this case, the printing equipment housing box 10 can eliminate the curl from the print medium 31 in the course of guiding the print medium 31 to the printing equipment 20 via the guiding members 184 and 185.

<Modified Examples>

The present disclosure is not limited to the above-described embodiment, and various modifications are possible. The above-described cover open portion 51A may be a hole that penetrates the plate-shaped member 51 in the front-rear direction. In the above description, a number of the regulating portions 733A and 733B is not limited to two, and may be one, or may be three or more. The first urging members 57A and 57B need not necessarily be provided. The cover 50 may be maintained to be disposed in the closed position by being supported, from below, by the inclined surfaces 74A and 74B of the regulating portions 733A and 733B. The second urging members 77A and 77B need not necessarily be provided. The user may manually switch the position of the button 71 from the second position to the first position.

In the above description, the center between the protrusion portions 552A and 552B in the left-right direction, and the center of the plate-shaped member 51 in the left-right direction respectively match the centers 12C and 50C. However, a position of the center between the protrusion portions 552A and 552B need not necessarily be disposed at the center of the plate-shaped member 51 in the left-right direction, and may be displaced to the left side or the right side. The handle 55 need not necessarily have the bridge portion 551, and may be configured by a single protrusion portion.

The shape of the engagement portion 511 of the plate-shaped member 51 of the cover 50 is not limited to that of the above-described embodiment. For example, the engagement portion 511 may be a groove portion provided on the upper side end portion of the plate-shaped member 51. The groove portion may extend in the left-right direction along the upper side surface. When the cover 50 is disposed in the closed position, the groove portion may fit, from below, into the upper side end portion of the concave portion 12A of the paper discharge port 12. The engagement portion 511 need not necessarily be provided on the plate-shaped member 51.

In the above description, the movement direction when the cover 50 moves from the open position toward the closed position is inclined toward the outside of the box 11 with respect to the up-down direction. However, when the cover 50 moves from the open position toward the closed position, the cover 50 may move along the up-down direction.

In the above description, the box hole portion 15 is disposed below the placement surface 172 of the pedestal 17. Thus, the overlapping section between the cover open portion 51A of the cover 50 and the box hole portion 15 is disposed below the placement surface 172. However, the box hole portion 15 may be disposed above the placement surface 172. In the above description, the lower side end portion of the core 30A of the roll 30 held by the roll holding portions 182 and 183 is disposed slightly below the placement surface 172 in the up-down direction. However, the lower side end portion of the core 30A of the roll 30 may be disposed above the placement surface 172 in the up-down direction. The guiding members 184 and 185 need not necessarily be provided. The print medium 31 may be directly fed to the printing equipment 20 from the roll 30.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printing equipment housing box comprising:

an equipment housing portion provided to house printing equipment;

an outer wall having a paper discharge port and a slit, the paper discharge port being a through hole and provided to discharge, from an inside to outside of the outer wall, a medium printed by the printing equipment housed in the equipment housing portion, the through hole extending in a first direction on the outer wall, the slit extending in a second direction orthogonal to the first direction;

a cover provided between the outer wall and the equipment housing portion, the cover capable of moving in a gap between the outer wall and the equipment housing portion in a second direction, the cover capable of moving between a closed position and an open position along an inner side of the outer wall, the cover closing the paper discharge port in the closed position and the cover opening the paper discharge port in the open position; and a handle provided on the cover, protruding further to the outside than the outer wall, and being capable of entering into the slit when the cover moves between the closed position and the open position.

2. A printing equipment housing box comprising:

an equipment housing portion provided to house printing equipment;

an outer wall with a paper discharge port, the paper discharge port being a through hole and provided to discharge, from an inside to an outside of the outer wall, a medium printed by the printing equipment housed in the equipment housing portion, the through hole extending in a first direction on the outer wall;

a cover provided between the outer wall and the equipment housing portion, the cover being capable of moving in a gap between the outer wall and the equipment housing portion in a second direction orthogonal to the first direction, the second direction being a direction of a virtual surface of an opening of the paper discharge port, the cover being capable of moving between a closed position and an open position along the inside of the outer wall, the cover closing the paper discharge port in the closed position and the cover opening the paper discharge port in the open position; and a holding apparatus capable of holding the cover in the open position on one side of the second direction further than the paper discharge port, wherein the cover moves along the outer wall from the one side to another side in the second direction when the holding apparatus releases the hold on the cover being held in the open position.

3. The printing equipment housing box according to claim 2, wherein the holding apparatus has an entering portion, and the entering portion protrudes in a third direction orthogonal to the first direction and the second direction and is capable of entering into a moving track of the cover in the third direction orthogonal to the first direction and the second direction and is capable of holding the cover in the open position.

4. The printing equipment housing box according to claim 2, further comprising:

a first elastic member configured to extend and contract along its length in the second direction and to urge the cover from the open position toward the closed position by extension of the first elastic member.

5. A printing equipment housing box comprising:

an equipment housing portion provided to house printing equipment;

an outer wall with a paper discharge port, the paper discharge port being a through hole and provided to discharge, from an inside to an outside of the outer wall, a medium printed by the printing equipment housed in the equipment housing portion, the through hole extending in a first direction on the outer wall;

a cover capable of moving, between a closed position and an open position along the outer wall in a second direction orthogonal to the first direction, the cover closing the paper discharge port in the closed position and the cover opening the paper discharge port in the open position;

a holding apparatus being capable of holding the cover in the open position;

a button capable of moving between a first position and a second position in a direction orthogonal to the outer wall and coupled to the holding apparatus; and extension portions extending from both sides of the button in the first direction and coupling the holding apparatus and the button;

wherein the holding apparatus is coupled to the button via the extension portions extending from both sides of the button in the first direction, and the extension portions and the holding apparatus separate from the cover and the holding apparatus releases the hold on the cover being held in the open position by moving the button in the direction orthogonal to the outer wall and disposing the button in the second position.

6. The printing equipment housing box according to claim 5, wherein the cover moves along the outer wall from one side to another side in the second direction when the holding apparatus releases hold on the cover being held in the open position.

7. The printing equipment housing box according to claim 5, wherein the holding apparatus holds the cover in the open position by moving the button in the direction orthogonal to the outer wall, disposing the button in the first position and engaging with the cover.

8. The printing equipment housing box according to claim 5, wherein the holding apparatus has an entering portion, and the entering portion protrudes in a third direction orthogonal to the first direction and the second direction and is capable of entering into a moving track of the cover in the third direction orthogonal to the first direction and the second direction and is capable of holding the cover in the open position.

9. The printing equipment housing box according to claim 5, further comprising:

a first elastic member configured to extend and contract along its length in the second direction and to urge the cover from the open position toward the closed position by extension of the first elastic member.

* * * * *